US007451969B2

(12) United States Patent
Böttcher et al.

(10) Patent No.: US 7,451,969 B2
(45) Date of Patent: Nov. 18, 2008

(54) GATHERER STITCHER

(75) Inventors: Rolf Böttcher, Markkleeberg (DE); Lutz Richter, Schkeuditz (DE); Andreas Steinert, Beucha (DE); Siegmar Tischer, Borsdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 320 days.

(21) Appl. No.: 11/122,858

(22) Filed: May 4, 2005

(65) Prior Publication Data

US 2005/0248076 A1 Nov. 10, 2005

(30) Foreign Application Priority Data

May 4, 2004 (DE) ..... 10 2004 021 958

(51) Int. Cl.
*B65H 39/00* (2006.01)

(52) U.S. Cl. ..... 270/52.14; 270/52.16; 270/52.18; 270/52.26; 270/52.29

(58) Field of Classification Search ..... 270/52.14, 270/52.16, 52.18, 52.26, 52.29; 271/202, 271/288; 412/33
See application file for complete search history.

(56) References Cited

U.S. PATENT DOCUMENTS

| | | | | |
|---|---|---|---|---|
| 2,251,943 | A * | 8/1941 | Kleineberg | 270/52.29 |
| 3,057,620 | A * | 10/1962 | McCain | 270/52.18 |
| 3,554,531 | A | 1/1971 | Heigl et al. | |
| 4,976,420 | A * | 12/1990 | Flensburg et al. | 270/52.28 |
| 5,326,087 | A | 7/1994 | Colson et al. | |
| 6,830,242 | B2 * | 12/2004 | Merkli | 270/52.29 |
| 2003/0061700 | A1 | 4/2003 | Steinert et al. | |
| 2005/0167902 | A1 * | 8/2005 | Mezger et al. | 270/58.08 |

FOREIGN PATENT DOCUMENTS

| | | |
|---|---|---|
| DE | 1 930 128 | 1/1970 |
| DE | 41 33 567 A1 | 4/1993 |
| DE | 197 52 015 A1 | 5/1999 |
| DE | 101 43 571 A1 | 3/2003 |
| EP | 0 916 514 A1 | 5/1999 |
| EP | 0 917 965 A1 | 5/1999 |
| GB | 1 275 635 | 5/1972 |

* cited by examiner

*Primary Examiner*—Gene O. Crawford
*Assistant Examiner*—Leslie Nicholson, III
(74) *Attorney, Agent, or Firm*—Laurence A. Greenberg; Werner H. Stemer; Ralph E. Locher

(57) ABSTRACT

To optimize the effort involved when converting a gatherer stitcher which transports initially continuously transported brochures step by step into a stitching station and subsequently into an output station, sensors are assigned to machine components affected by geometrical parameters that are relevant to the process when there is a change of job order and to a reference component. The sensors emit signals defining the phase positions of the machine components, and a controller processing the signals coordinates the phase positions with at least one of the parameters in such a way that the brochures arrive in the output station in a center-oriented manner.

6 Claims, 8 Drawing Sheets

GATHERER STITCHER

BACKGROUND OF THE INVENTION

Field of the Invention

The invention relates to a gatherer stitcher for brochures with an output station, machine components which contain a stitching machine, a continuous conveyor, feeders for charging the continuous conveyor with signatures, an operationally oscillating finger strip system containing activatable fingers for the step-by-step transport of the brochures and a finger actuating gear mechanism activating the fingers, and with a drive device for the machine components.

Gatherer stitchers of this type have been sold by Brehmer Buchbindereimaschinen GmbH, Leipzig, under the type designation ST300. They represent an alternative to gatherer stitchers in which the brochures are transported by a continuous conveyor in the form of a gatherer chain configuration up to an output station following a stitching station, and have the advantage over the latter with regard to the quality of the stitching that the stitching takes place while the brochures are at a standstill. However, the trade-off for this advantage is the relatively great effort involved in the conversion that has to be made when there is a change in a geometrical parameter of the brochures that is relevant to the process, such a conversion also demanding quite a lot of mechanical engineering knowledge of the personnel carrying it out.

To this extent, the invention is based on the object of developing a gatherer stitcher of the type stated at the beginning in such a way that it can be converted with as little effort as possible when a geometrical parameter of the brochures that is relevant to the process changes from one order to a subsequent order.

SUMMARY OF THE INVENTION

It is accordingly an object of the invention to provide a gatherer stitcher which overcomes the above-mentioned disadvantages of the prior art devices of this general type.

With the foregoing and other objects in view there is provided, in accordance with the invention, a gatherer stitcher for brochures. The gatherer stitcher contains an output station and machine components including a stitching machine disposed upstream of the output station, a continuous conveyor, feeders for charging the continuous conveyor with signatures and disposed upstream of the stitching machine, an operationally oscillating finger strip system containing activatable fingers for a step-by-step transport of the brochures and a finger actuating gear mechanism activating the activatable fingers. Drive devices are provided for driving the machine components. Sensors are assigned to a respective one of the machine components serving as a reference component and to further selected machine components. The sensors emit signals defining phase positions of the reference component and of the selected machine components. A controller processes the signals and acts on the selected machine components. The controller coordinates the phase positions of the selected machine components with at least one geometrical parameter of the brochures being relevant such that the brochures are aligned in a substantially center-oriented manner in the output station.

To achieve the object, the gatherer stitcher mentioned at the beginning is equipped with sensors assigned to a machine component serving as a reference component and to further selected machine components. The sensors emit signals defining the phase positions of the reference component and of the selected machine components, and with a controller processing the signals and acting on the selected machine components. The controller coordinates the phase positions of the selected machine components with at least one geometrical parameter of the brochures that is relevant to the process in such a way that the brochures are aligned in a substantially center-oriented manner in the output station.

A spine length of the brochures and their thickness come into consideration as geometrical parameters that are relevant to the process. The coordination of the phase positions of individual machine components with at least one of these parameters, to be precise preferably with a change in the spine length of the brochures when there is a change of job order, is required to the extent that the output station is usually followed by a trimming station with a preceding feed, which feeds the stitched brochures to front and side cutting knives transversely in relation to the conveying direction previously determined by the continuous conveyor and the finger strip system. However, the side cutting knives are adjustable symmetrically in relation to the longitudinal center of the feed and to this extent require a center-oriented alignment of the brochures in the output station preceding the feed for the correct implementation of the top cut and the bottom cut.

In the case of notable differences in thickness of the brochures of two different orders, a corresponding coordination of the phase position of a further machine component is also recommendable.

The machine components that are respectively affected by the coordination of the phase positions is discussed in more detail in the text which follows.

Other features which are considered as characteristic for the invention are set forth in the appended claims.

Although the invention is illustrated and described herein as embodied in a gatherer stitcher, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
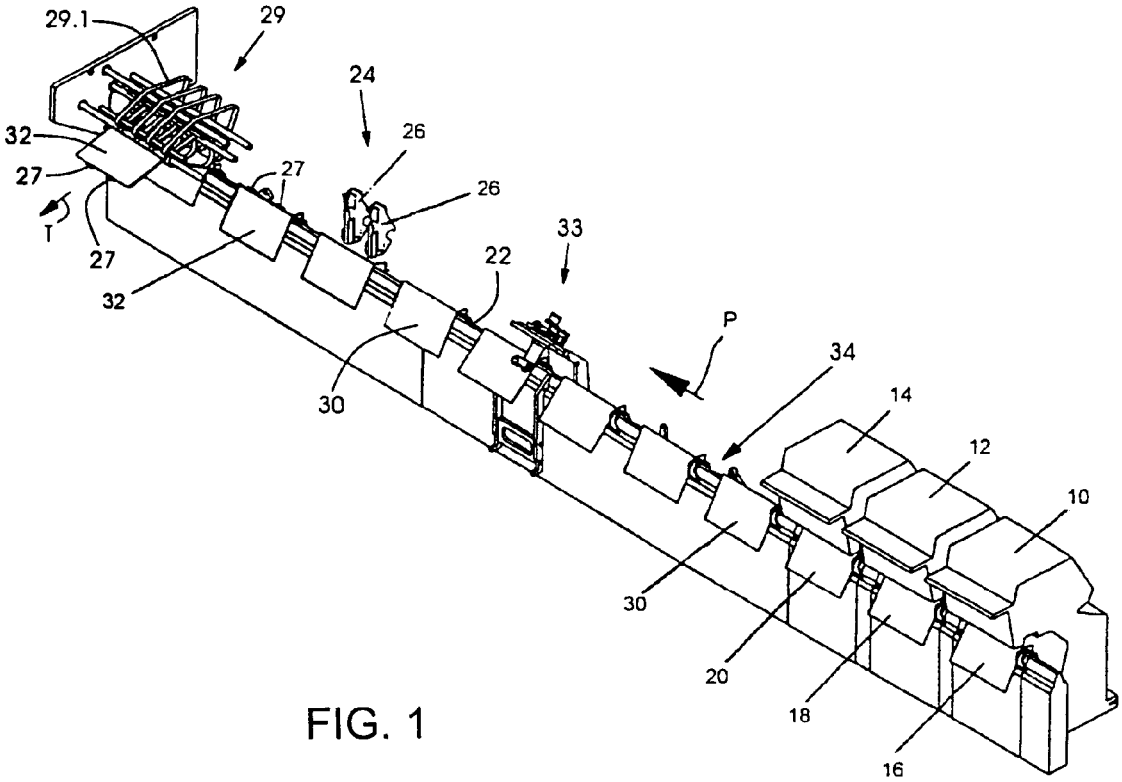
FIG. 1 is a simplified diagrammatic, perspective view of a gatherer stitcher for brochures, the gatherer stitcher has feeders, a stitching station and a then following output station and also with a transporting device (not represented in detail here), which convey signatures delivered by the feeders to the stitching station and subsequently to the output station according to the invention.

Referring now to the figures of the drawing in detail and first, particularly, to FIG. 1 thereof, there is shown an exemplary embodiment of machine components of the gatherer stitcher which contains three feeders 10, 12, 14, which respectively transfer a signature 16, 18, 20 to a continuous conveyor 34. The signatures 16, 18, 20 deposited and placed one on top of another in this way together form a brochure 30, which, like the previously forming brochure, is transported in a transporting direction according to arrow P along a transporting and stitching line 22, which extends along the feeders 10, 12, 14 and beyond a stitching station 24 to an output station 29. In the case of the present exemplary embodiment, the stitching station 24 contains two stitching heads 26 and a bending element 5, which cannot be seen in FIG. 1, are respectively assigned to the stitching heads and, by use of the stitching heads 26, bend wire staples 27 with which the brochures 30 to be stitched are punctured, to be precise bend the legs of the wire staples 27 which have penetrated through the brochures 30.

Together with the stitching heads 26 and devices not represented for producing the wire staples 27, the bending elements form a machine component in the form of a stitching machine.

In the case of the present exemplary embodiment, the output station 29 contains a machine component in the form of an ejector blade and delivery belts 29.1. The ejector blade engages in the respective fold of stitched copies 32, lifts them out of the transporting and stitching line 22 and transfers them to the delivery belts 29.1, by which the stitched copies 32 are transported further in the direction of arrow T, to be precise preferably in the direction of a trimming device.

Provided upstream of the stitching station 24 with respect to the transporting direction according to the arrow P is a measuring station 33, in which the thickness of the brochures 30 to be stitched is determined.

In the present exemplary embodiment, the continuous conveyor 34 is formed as an endless operationally circulating gatherer chain, on which drivers 34.2 are disposed, pushing in front of them the signatures 16, 18, 20 transferred hereby astride to the gatherer chain, and finally the brochures 30 to be stitched.

Figure 2:
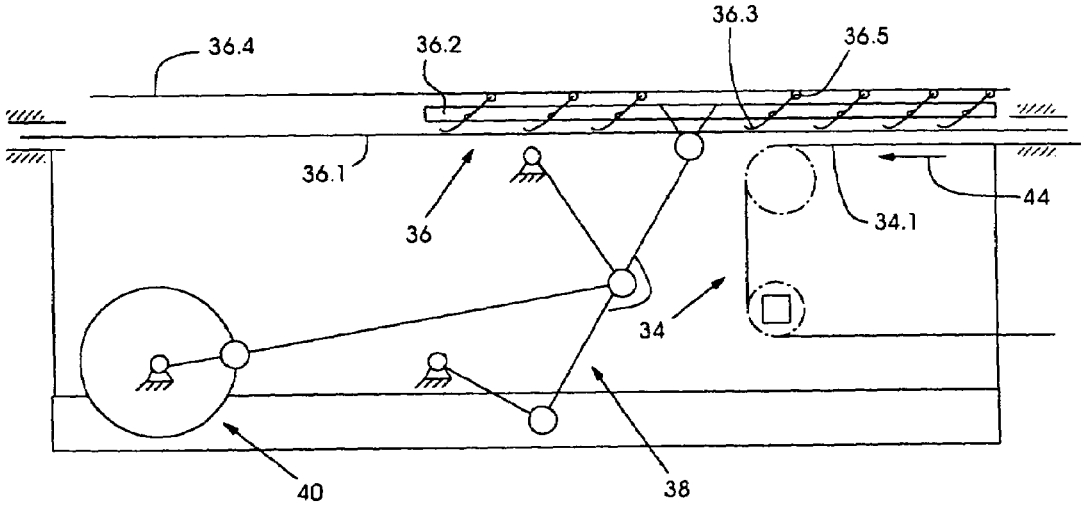
FIG. 2 is an illustration of a portion of the transporting device covering the stitching station, which contains a continuous conveyor and an operationally oscillating finger strip system with activatable fingers following the continuous conveyor.

FIG. 2 shows a portion of the transporting and stitching line 22 covering the stitching station 24. In this portion, a transporting strand 34.1 of the continuous conveyor 34 formed as a gatherer chain ends and the further transport of the brochures 30 takes place step by step by an operationally oscillating finger strip system 36. This is merely schematically shown in FIG. 2. It contains an anvil strip 36.1 for engaging under the brochures 30 to be stitched and a finger strip 36.2 oscillating together with the anvil strip 36.1. Disposed on the finger strip 36.2 are activatable fingers 36.3. The fingers 36.3 are activatable to the extent that they are pivotably articulated on the finger strip 36.2 in the direction toward the anvil strip 36.1 and in the opposite direction, are pretensioned in the pivoting direction toward the anvil strip 36.1 and can be pivoted away, in particular from the anvil strip 36.1, under the effect of a control strip 36.4. The fingers 36.3 are preferably provided at their ends facing the control strip 36.4 with freely rotatable rollers 36.5, which roll on the control strip 36.4 when there is an adjustment of the control strip 36.4 in the direction of the finger strip 36.2 or in the opposite direction. The activation of the fingers 36.3 and of the control strip 36.4 will be discussed in more detail later.

For the oscillating movement of the finger strip system 36, the latter is articulated on a couple of a coupling drive mechanism 38, which for its part is driven by a crank drive 40. The drive devices provided for the actuation of the crank drive 40, and consequently for the oscillating movement of the machine component taking the form of the finger strip system 36, are represented in the case of the present exemplary embodiment by a stitching machine drive 42 that is also provided for the actuation of the stitching heads 26 (see FIG. 5).

In FIG. 2, the crank drive 40 is shown in its extended position, which may be given a crank angle of 0 degrees. In this extended position, the finger strip system 36 reverses its direction of movement and, until the coincidence of the crank drive 40 is achieved, moves in a direction indicated by arrow 44, in which the transporting strand 34.1 of the continuous conveyor 34 is also moving. In any event with the crank angle of 0 degrees and at least up to a certain crank angle—in the case of the present exemplary embodiment of 16 degrees—the anvil strip 36.1 and the finger strip 36.2 on the one hand and the transporting strand 34.1 of the continuous conveyor 34 are overlapped, so that the anvil strip 36.1 can engage under a brochure 30 located positionally correctly on the transporting strand 34.1 and the fingers 36.3 of the finger strip 36.2 can press the brochure 30 against the anvil strip 36.1. This takes place with matching speeds of the finger strip system 36 and the continuous conveyor 34—in the present exemplary embodiment with a crank angle of 16 degrees, which consequently defines a gripping point.

Figure 3:
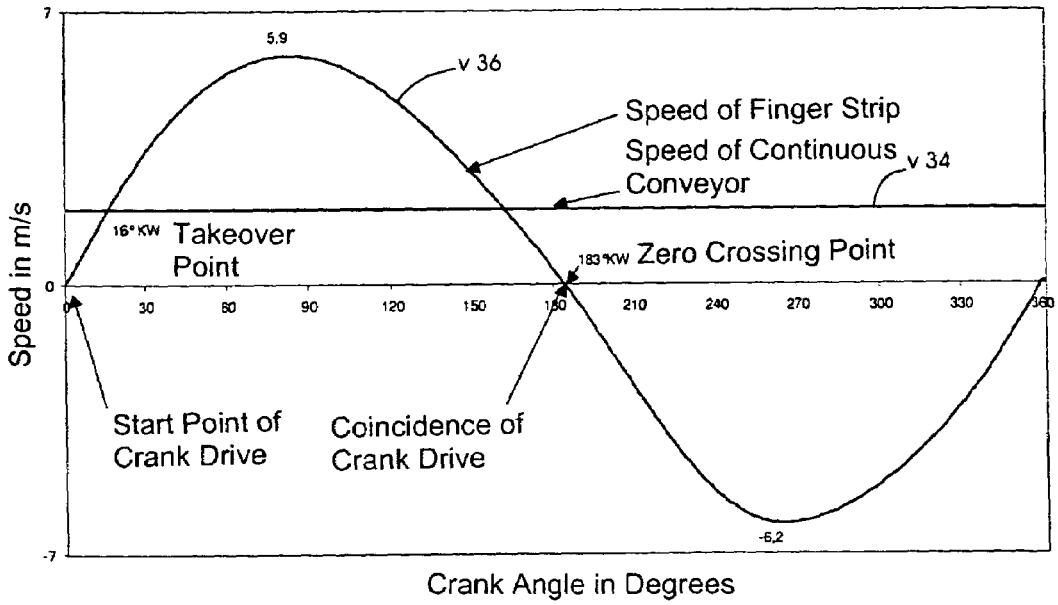
FIG. 3 is a graph showing the kinematic interrelationship of the continuous conveyor and the finger strip system.

As indicated in FIG. 3, with the crank angle of 16 degrees a speed v36 of the finger strip system 36 has reached a speed v34 of the transporting strand 34.1 of the continuous conveyor 34. This is the predestined operating state for the taking over of the brochure 30 positioned positionally correctly on the continuous conveyor 34 by the finger strip system 36, to be precise by pressing of the fingers 36.3 against the anvil strip 36.1.

As FIG. 3 further reveals, the speed v36 of the finger strip system 36 assumes a progression similar to a sine curve and has in the case of the present exemplary embodiment its zero crossing with a crank angle of 183 degrees at the coincidence of the crank drive 40. With this crank angle, the operating state predestined for depositing the brochure 30 previously taken up by the finger strip system 36 on the transporting and stitching line 22 is then reached. The zero crossing consequently defines a depositing point. The depositing takes place in particular by the fingers 36.3 that are pretensioned in the direction of the anvil strip 36.1 being lifted off the anvil strip 36.1.

Once the zero crossing of the speed v36 of the finger strip system 36 has taken place at the coincidence of the crank drive 40, the finger strip system 36 reverses its direction of movement and finally resumes an overlapped position with the transporting strand 34.1 of the continuous conveyor 34 corresponding to the crank angle of 0 degrees, that is to say the starting point for a further cycle of the type described above.

The finger strip system 36 consequently transports a brochure taken over from the continuous conveyor 34 step by step with a step length which corresponds to a path which, beginning at the gripping point, is covered by the time the depositing point is reached.

A brochure 30 that in one cycle of the finger strip system 36 is taken over from the continuous conveyor 34 and, after a first step, is deposited on the transporting and stitching line 22 is taken up once again by the finger strip system 36 in the following cycle and transported further one more time by the step length. For a respective brochure 30, this process is repeated until the output station 29 has been reached once stitching has taken place.

Figure 4:
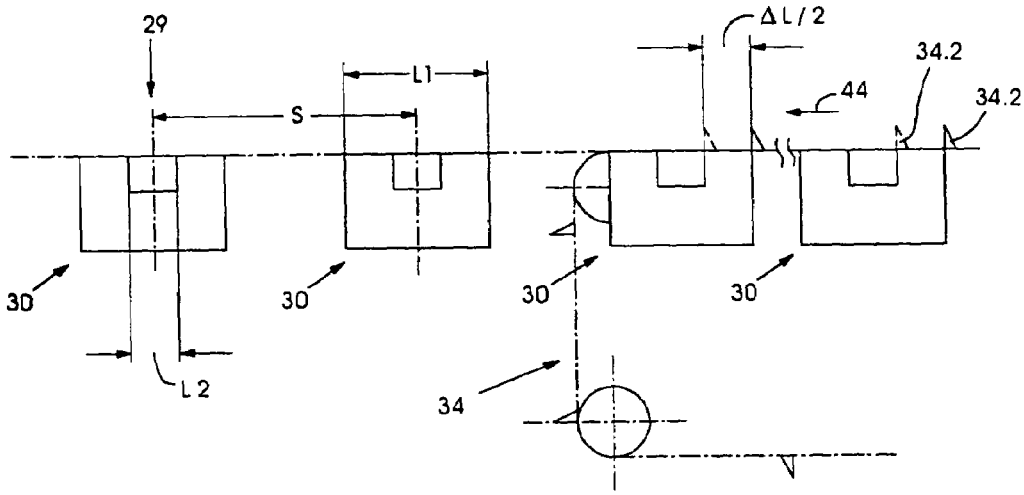
FIG. 4 is an illustration showing a transfer of brochures of different spine lengths from the continuous conveyor to the finger strip system.

As already mentioned and indicated in FIG. 4, the brochures 30 must be aligned in a center-oriented manner in the output station 29. Although it is evident hereafter that, and how, the finger strip system 36 can be influenced with regard to a displacement of the depositing point, the order of magnitude of the displacement that can be achieved thereby is not adequate for an adaptation to a geometrical parameter that is relevant to the process in the form of the spine length of the brochures 30.

It is evident from joint consideration of FIGS. 2 and 4 that retaining the phase position of the crank drive 40 for a conversion from a format with a spine length L1 to a format with a spine length L2 of the brochure 30 gives rise to the necessity for a phase adjustment of the continuous conveyor 34 with respect to the crank drive 40, resulting furthermore in the necessity for a phase adjustment of the feeders 10, 12, 14 with respect to the crank drive 40 or with respect to the continuous conveyor 34.

This is so because, if the steps covered by the finger strip system 36, indicated in FIG. 4, with a step length S are imagined as being covered in the reverse direction, starting from the output station 29 through to the continuous conveyor 34, it becomes clear that, with a spine length L2 of the brochures 30, which is shorter than a spine length L1 by a difference in spine length Delta L, the drivers 34.2 of the continuous conveyor 34 must be displaced in the transporting direction according to arrow 44 by half the difference in spine length Delta L. The phase position of the continuous conveyor 34 must therefore be adjusted in the transporting direction according to arrow 44 by an angle corresponding to half the difference in spine length Delta L.

Figure 5:
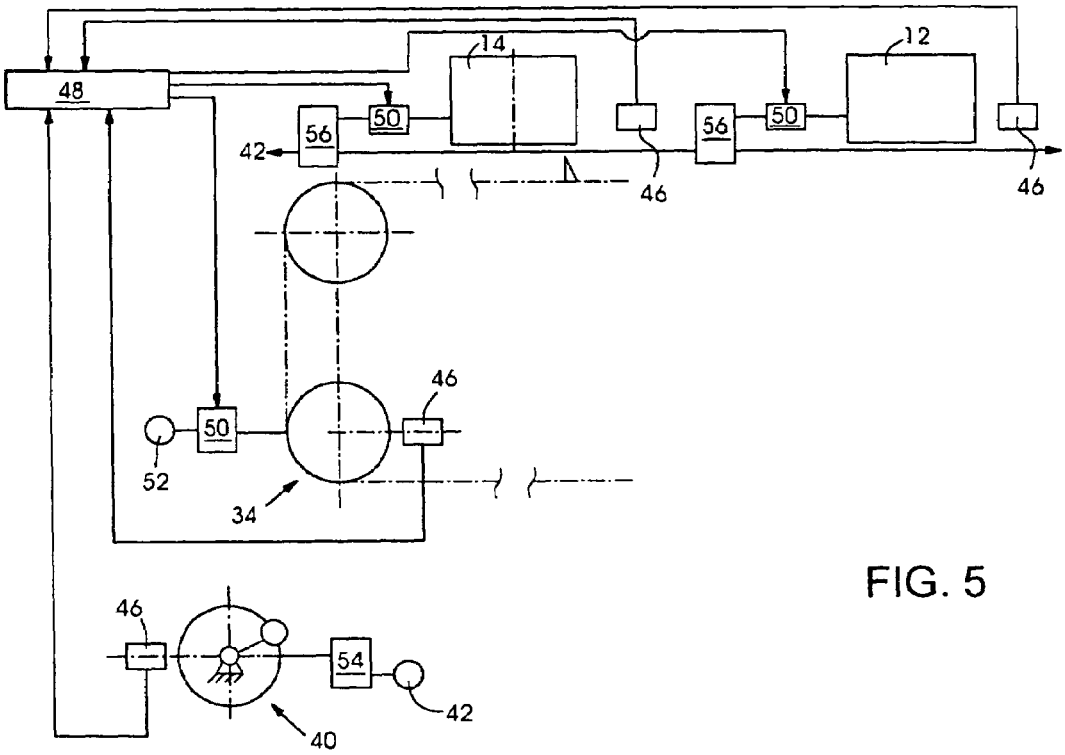
FIG. 5 is a block diagram for a coordination of the phase positions of selected machine components of the gatherer stitcher with a geometrical parameter of the brochures that is relevant to the process.

As indicated in FIG. 5, to this extent selected machine components—here the continuous conveyor 34 and the feeders 10, 12, 14—and also a machine component serving as a reference component in the form of the stitching machine, to be more specific the crank drive 40 driven by the stitching machine drive 42, are assigned sensors 46, which emit signals defining the phase positions of the reference component and of the selected machine components. The signals are processed in a controller 48, which acts on the selected machine components—here the continuous conveyor 34 and the feeders 10, 12, 14—and coordinates the phase positions of the selected machine components with the geometrical parameter that is relevant to the process in the form of the spine length of brochures 30 otherwise of a similar kind, by way of example, in such a way that the brochures 30 are aligned in a center-oriented manner in the output station 29.

However—as illustrated in the text, which follows—an alignment that remains center-oriented not just in approximation but in actuality when there is a change of job order is only achieved without further measures if only the geometrical parameter of the spine length changes.

As further indicated in FIG. 5, the selected machine components, here the continuous conveyor 34 and the feeders 10, 12, 14, are connected to their drive devices in a particularly advantageous way for the controller 48 to have its effect, via couplings 50, the stitching machine drive 42 being provided in the case of the present exemplary embodiment as the drive device for the feeders 10, 12, 14 and a separate conveying drive 52 as the drive device for the continuous conveyor 34, and the stitching machine drive 42 and the conveying drive 52 preferably being formed as servo drives.

For shared use of the stitching machine drive 42 for operating the finger strip system 36 via the crank drive 40 and the feeders 10, 12, 14, gear mechanisms 54, 56 are disposed upstream of the corresponding machine components, as indicated in FIG. 5. Accordingly, the same procedure in principle can also be followed for operating the continuous conveyor 34, that is to say the stitching machine drive 42 can likewise be used as the drive device for it if a gear mechanism is provided between it and the continuous conveyor 34, or preferably the coupling 50 disposed upstream of the continuous conveyor 34.

The couplings 50 are understood as meaning not only physically present couplings, such as electromagnetic clutches for example, but also logic operations linking the controller 48 with one of the drive devices, as is provided in the case of the conveying drive 52 in the case of a preferred exemplary embodiment.

The controller 48 acts via the couplings 50 on the selected machine components, to be precise by it decoupling a respective one of the selected machine components from its drive device and coupling it again individually to the respective drive device with a correspondingly changed phase position of the latter.

With a change in the spine length as the one and only parameter that is relevant to the process in the case of a change of job order, the controller 48 brings about the coupling of the selected machine components, here the feeders 10, 12, 14 and the continuous conveyor 34, to the assigned drive devices, here the stitching machine drive 42 and the conveying drive 52, with phase positions changed in such a way that the brochures 30 arrive in the output station 29 aligned in a center-oriented manner.

Figure 6:
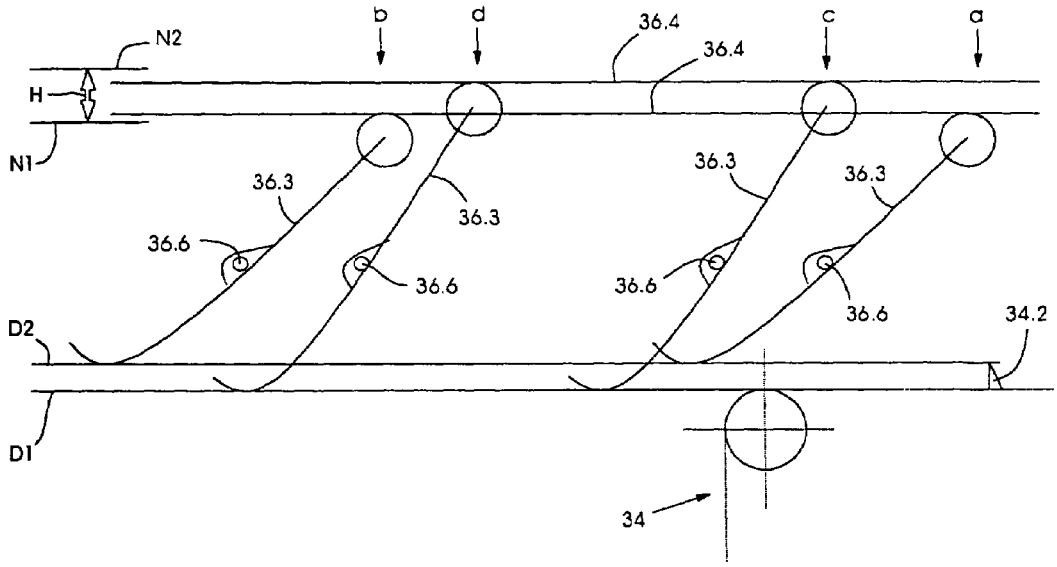
FIG. 6 is an illustration showing the influence of the thickness of the brochures on the function of the finger strip system.
Figure 7:
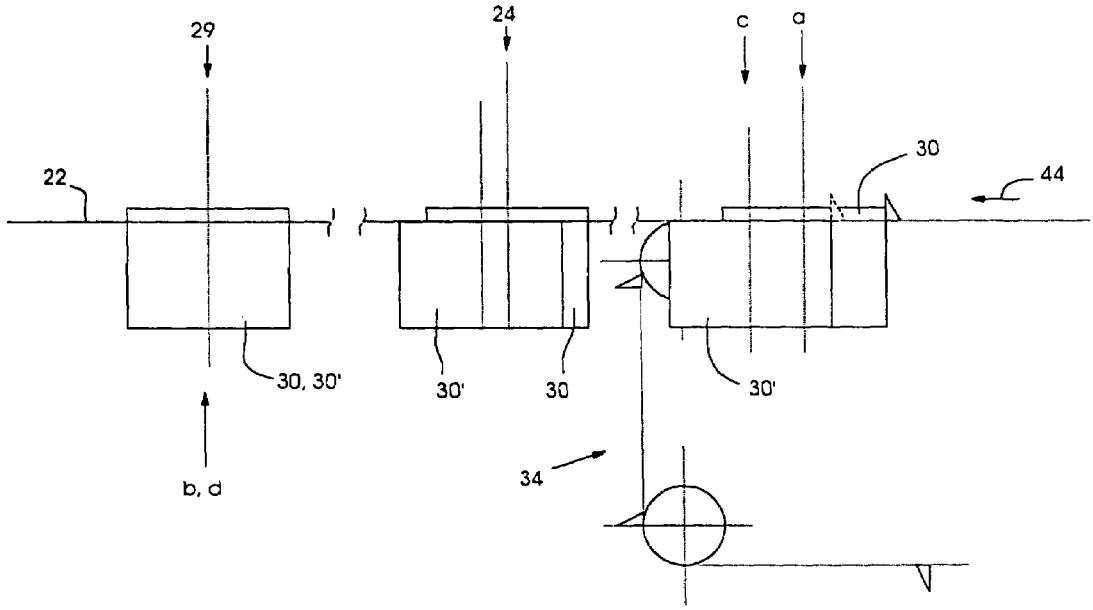
FIG. 7 is an illustration showing the functional interrelationship of the continuous conveyor and the finger strip system with different thicknesses of the brochures.

As already mentioned and now explained on the basis of FIGS. 6 and 7 in conjunction with FIG. 2, the thickness of the brochures proves to be a further geometrical parameter that is relevant to the process. Here it is found for a change of job order in which both the spine length and the thickness of the brochures 30 change that, in the event that the machine components selected for coordination of the phase position merely contain the feeders 10, 12, 14 and the continuous conveyor 34, the alignment of the brochures 30 in the output station merely remains substantially center-oriented.

The taking-over of the brochures 30 by the finger strip system 36 and the depositing of the same on the transporting and stitching line 22 extending into the output station 29 is accomplished by the control strip 36.4, which can be seen in FIG. 2, and a further machine component in the form of a finger actuating gear mechanism 58 (see FIGS. 8 and 9), which actuates the control strip 36.4 and is discussed in more detail in the text which follows.

FIG. 6 shows a finger 36.3 of the finger strip system 36 in interaction with the control strip 36.4 and with brochures of different thicknesses in various operating states a, b, c, d in a schematic representation, which reveals the roller 36.5 rolling on the control strip 36.4 and the indication of an articulated connection 36.6 with the finger strip 36.2. In the case of a respective one of the cycles of the finger strip system 36 explained earlier, the control strip 36.4 first performs a stroke with a stroke length H, starting from a first level N1, in the direction of a second level N2, in order to press one of the brochures 30 by the fingers 36.3 pre-tensioned in the direction of the anvil strip 36.1 against the anvil strip 36.1 at the point in time when the amount and direction of the speed v36 of the finger strip system 36 coincide with the amount and direction of the speed v34 of the continuous conveyor 34, that is to say at the gripping point explained earlier, so that as from this gripping point—in operating state a—the step-by-step transport of the brochure takes place by the finger strip system 36. Shortly before reaching the step length of the step-by-step transport, the control strip 36.4 performs a stroke with once again the stroke length H, starting from the second level N2, back to the first level N1, in order to release the brochure 30 transported step by step at a depositing point in time—in operating state b—at which the speed v36 of the finger strip system 36 transporting the brochure 30 reaches its zero crossing—in the present exemplary embodiment with a crank angle of the crank drive 40 actuating the finger strip system 36 of 183 degrees (see FIG. 3).

The control strip 36.4 performs the stroke from the second level N2 to the first level N1 counter to the action of the pretension of the fingers 36.3 that exists in the direction of the anvil strip 36.1. The stroke movements of the control strip 36.4 are impressed on the latter by a cam follower configuration, which will be discussed in more detail in the text, which follows. In FIG. 6, the continuous conveyor 34 with one of its drivers 34.2 is schematically shown, and a thin brochure 30' is indicated by the line D1 and a thick brochure 30 is indicated by the line D2 (see also FIG. 7). The operating state a is to be understood as meaning that state in which the finger 36.3 presses a thick brochure 30, transported to this point by the continuous conveyor 34, against the anvil strip 36.1 under its pretension during the stroke of the control strip 36.4 from the level N1 to the level N2 at the gripping point explained, that is to say when the amount and direction of the speed v34 of the continuous conveyor 34 coincide with the amount and direction of the speed v36 of the finger strip system 36. The operating state continues until the control strip 36.4, during its stroke from the level N2 to the level N1 counter to the pretension of the finger 36.3, releases at a depositing point in time reached in the operating state b, at which the speed v36 of the finger strip system 36 transporting the brochure 30 has its zero crossing, and subsequently returns again into the position in which it overlaps with the continuous conveyor 34 in order to start the next cycle.

If the cam follower configuration mentioned and its operation for the stroke movement of the control strip 36.4 are retained and the above operations are repeated with a thin brochure 30', an operating state c corresponding to the operating state a is obtained—brochure clamped—obviously at a later point in time, since, with the stroke movement of the control strip 36.4 retained, the finger 36.3 reaches the thin brochure 30' later than the thick brochure 30. However, the operating state d, corresponding to the operating state b, is obtained at an earlier point in time, since, during the stroke of the control strip 36.4 from level N2 to level N1, the finger 36.3 obviously lifts off earlier from the thin brochure 30' than from a thick brochure.

In order to stitch and trim brochures 30 or 30' with particularly stringent requirements for their quality, the operating states a and c must be reached at one and the same point in time at the beginning of a transporting step and the operating states b and d must be reached at one and the same point in time at the end of the transporting step. This would produce not only correct trimming but also an always correct position of the wire staples 27.

Shown in FIG. 7 is the result of a compromise solution, in which it is provided that brochures 30 and 30', that is to say brochures of different thicknesses but the same spine length, are in actuality aligned in a center-oriented manner merely in the output station 29. Therefore, although the thickness—dependent displacement of the gripping point, that is to say the time interval between the operating states a and c—thick brochure 30 clamped in the region of the continuous conveyor 34 and thin brochure 30' clamped in the region of the continuous conveyor 34—is accepted, it is ensured by a corresponding thickness-dependent phase displacement of the further machine components already mentioned earlier in the form of the finger actuating gear mechanism 58 that the depositing of brochures of different thicknesses always takes place at one and the same location in the output station 29, to be precise in a center-oriented manner, the gripping point being displaced—as FIG. 7 reveals—in the case of the thin brochure 30' in comparison with that in the case of the thick brochure 30 in the transporting direction according to arrow 44 and different stitching positions of the brochures 30 and 30' also being obtained in the stitching station 24.

Figure 9:
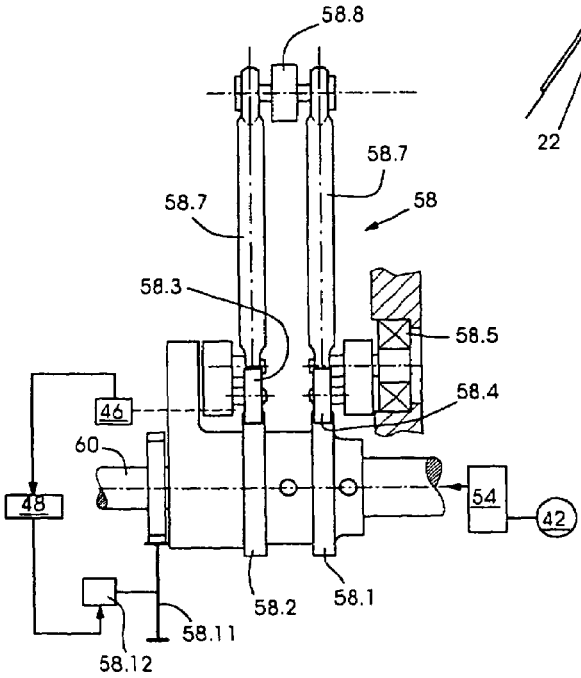
FIG. 9 is a diagrammatic, sectional view of details of the finger actuating gear mechanism according to FIG. 8 in a view in the direction of the arrow IX shown in FIG. 8.
Figure 8:
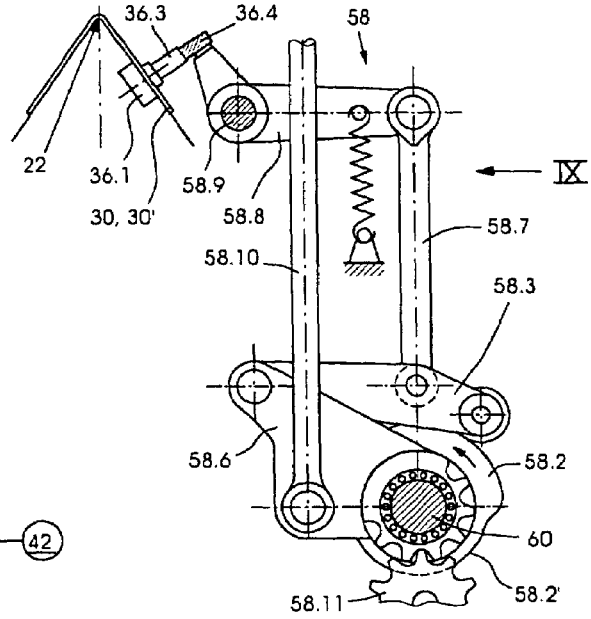
FIG. 8 is a diagrammatic, sectional view of a brochure taken up by the finger strip system in relation to the transporting direction of the brochures and a machine component in the form of a finger actuating gear mechanism for activating the fingers of the finger strip system.

Shown in FIGS. 8 and 9 is an exemplary embodiment of the finger actuating gear mechanism 58, which controls the explained stroke movements of the control strip 36.4. As already explained, the mechanism contains a cam follower configuration. The configuration contains two control cams connected in a rotationally fixed manner to a drive shaft 60. As schematically represented in FIG. 9, the drive shaft 60 is driven in the case of the present exemplary embodiment by the stitching machine drive 42 via a gear mechanism 54. A first control cam 58.1 serves for controlling the clamping of the brochures 30 or 30' in the finger strip system 36 and a second control cam 58.2 brings about the release of the brochures 30 or 30' previously clamped in the finger strip system. The phase positions of the two control cams 58.1 and 58.2 are preferably set to an average thickness of the brochures 30 and 30'. Respectively set against the control cams 58.1 and 58.2 is a cam follower 58.3 and 58.4, which respectively contain a pivot arm and, mounted freely rotatably on it, a cam follower roller, which operationally rolls on the respectively associated one of the control cams 58.1 and 58.2. The pivot arm of the cam follower 58.4 set against the control cam 58.1 is accommodated in a pivot bearing 58.5 that is fixed to the frame, while, as a departure from this, the pivot arm of the cam follower 58.3 assigned to the control cam 58.2 for controlling the release of the brochures 30, 30' previously clamped in the finger strip system 36 is pivotably accommodated in a bearing plate 58.6, which for its part is carried by the drive shaft 60 rotatably with respect to the latter.

The respective cam follower 58.3 and 58.4 is articulated with a link 58.7 in each case on a tilting lever 58.8, which is shared by the two cam followers 58.3 and 58.4, is mounted preferably by an elongated bearing sleeve on a tilting shaft 58.9 parallel to the transporting and stitching line 22 and preferably has a plurality of arms which connect the bearing sleeve to the control strip 36.4. The cam follower 58.3, the control cam 58.2 of which is provided for controlling the cyclical depositing of the brochures 30, 30' on the transporting and stitching line 22 and for their release in the output station 29, is adjustable in the circumferential direction of the control cam 58.2 with respect to the latter as a consequence of its articulation on the bearing plate 58.6, which is rotatable with respect to the drive shaft 60. This allows the already explained phase adjustment of the finger actuating gear mechanism 58, dependent on the thickness of the brochures 30, 30', to be realized. For the adjustment of the phase position, an arrestable pushing and pulling rod 58.10 may be provided, articulated on the bearing plate 58.6.

In a particularly advantageous way, the adjustment of the phase position for different thicknesses takes place automatically by connection of the machine component representing the finger actuating gear mechanism 58 to the controller 48, which is correspondingly configured also to process signals defining the phase position of the finger actuating gear mechanism 58 and to coordinate the phase position of this machine component with the geometrical parameter of the thickness of the brochures 30, 30' in such a way that the brochures 30, 30' are aligned in a center-oriented manner in the output station 29.

For the emission of signals defining the phase position of the finger actuating gear mechanism 58, the sensor 46 linked to the controller 48 is in turn provided, emitting a signal for example if the cam follower 58.3 leaves an inner latching path 58.2' of the control cam 58.2.

Among the devices that come into consideration for the adjustment of the phase position of the finger actuating gear mechanism 58 are a spindle drive arrangement, rotating the bearing plate 58.6, or a correspondingly acting toothed gear mechanism and a corresponding drive.

In the example represented according to FIGS. 8 and 9, a toothed gear mechanism is provided in such a way that a bearing bush of the bearing plate 58.6 is provided with a toothed rim, which meshes with an adjusting pinion 58.11, which is rotatable by an adjusting drive 58.12 activated by the controller 48.

With the corresponding adjustment, explained to this extent, of the phase position of the finger actuating gear mechanism 58 in dependence on the thickness of the brochures 30, 30', their center-oriented depositing is successfully obtained thickness-independently at the coincidence of the crank drive 40.

If geometrical parameters that are relevant to the process in the form of the spine length and the thickness of the brochures change when there is a change of job order, the phase adjustments explained must be performed not only on the continuous conveyor 34 but also in the case of the feeders 10, 12, 14 and in the case of the finger actuating gear mechanism 58, i.e. all these machine components are to be assigned the sensors 46 mentioned, and the controller 48 processing their signals, which define phase positions of these machine components, is to be provided, which controller coordinates the phase positions of all these machine components with the two parameters in such a way that the brochures 30, 30' of the new order also arrive in the output station 29 in a center-oriented manner.

This application claims the priority, under 35 U.S.C. § 119, of German patent application No. 10 2004 021 958.3, filed May 4, 2004; the entire disclosure of the prior application is herewith incorporated by reference.

We claim:

1. A gatherer stitcher for brochures, comprises:

an output station;

machine components including:

a stitching machine disposed upstream of said output station;

a continuous conveyor being an endless gathering chain;

feeders for charging said continuous conveyor with signatures and disposed upstream of said stitching machine;

a linearly oscillating finger strip system containing activatable fingers configured for a step-by-step transport of the brochures off of said continuous conveyor; and a finger actuating gear mechanism activating said activatable fingers;

drive devices for driving said machine components;

sensors assigned to a respective one of said machine components serving as a reference component and to further selected said machine components, said sensors emitting signals defining phase positions of said reference component and of said selected machine components; and a controller processing the signals and acting on said selected machine components, said controller coordinating the phase positions of said selected machine components with at least one geometrical parameter of the brochures being relevant such that the brochures are aligned in a substantially center-oriented manner in said output station.

2. The gatherer stitcher according to claim 1, wherein the geometrical parameter of the brochures is a spine length of the brochures, said selected machine components include said continuous conveyor and said feeders.

3. The gatherer stitcher according to claim 1, wherein the geometrical parameter of the brochures is a spine length and a thickness of the brochures, said selected machine components contain said continuous conveyor, said feeders and said finger actuating gear mechanism.

4. The gatherer stitcher according to claim 1, wherein said drive devices for said selected machine components include couplings by which each of said machine components can be coupled individually to one of said drive devices, and in that said controller is linked with said couplings.

5. The gatherer stitcher according to claim 4, wherein said feeders can be coupled to a shared drive of said drive devices.

6. The gatherer stitcher according to claim 1, wherein said output station has an ejector blade and delivery belts.

* * * * *